US009683449B2

(12) United States Patent
He et al.

(10) Patent No.: US 9,683,449 B2
(45) Date of Patent: Jun. 20, 2017

(54) STATOR VANE ROW

(71) Applicant: ROLLS-ROYCE PLC, London (GB)

(72) Inventors: Li He, Oxford (GB); Amir Rahim, Ilford Essex (GB); Bidur Khanal, Oxford (GB); Eduardo Romero, Bristol (GB)

(73) Assignee: ROLLS-ROYCE plc, London (GB)

( * ) Notice: Subject to any disclaimer, the term of this patent is extended or adjusted under 35 U.S.C. 154(b) by 448 days.

(21) Appl. No.: 14/192,363

(22) Filed: Feb. 27, 2014

(65) Prior Publication Data

US 2014/0245741 A1 Sep. 4, 2014

(30) Foreign Application Priority Data

Mar. 4, 2013 (GB) ..... 1303767.6

(51) Int. Cl.
*F01D 9/04* (2006.01)
*F01D 5/14* (2006.01)

(52) U.S. Cl.
CPC ..... *F01D 9/041* (2013.01); *F01D 5/141* (2013.01); *F01D 5/145* (2013.01); *F01D 5/146* (2013.01);
(Continued)

(58) Field of Classification Search
CPC ..... F01D 9/041; F01D 9/042; F01D 9/044; F01D 9/04; F01D 5/141; F01D 5/146; F01D 5/145; F01D 25/06; F05D 2250/73; F05D 2250/38; F05D 2240/12; F05D 2240/123; F05D 2240/124; F05D 2260/961; F02C 7/24
See application file for complete search history.

(56) References Cited

U.S. PATENT DOCUMENTS

2004/0101405 A1 5/2004 Turner et al.
2008/0152505 A1* 6/2008 Burton ..... F01D 5/141 416/223 R
(Continued)

FOREIGN PATENT DOCUMENTS

EP 2 581 556 A2 4/2013
WO WO 2013/018073 A1 2/2013

OTHER PUBLICATIONS

Aug. 13, 2013 Search Report issued in United Kingdom Application No. 1303767.6.

*Primary Examiner* — Andrew Nguyen
(74) *Attorney, Agent, or Firm* — Oliff PLC

(57) ABSTRACT

In a gas turbine engine, each vane has pressure and suction surfaces extending radially from an inner to outer endwall of an annular working gas engine passage, and extending axially from a leading to a trailing edge of the vane. Each vane has transverse sections providing respective aerofoil sections. Neighboring vanes are arranged in unequally-shaped pairs in which either: (i) the first vane of each pair exhibits compound lean, and the second vane of the pair exhibits reverse compound lean or has substantially no tangential lean, (ii) the first vane of each pair has substantially no tangential lean, and the second vane of the pair exhibits reverse compound lean, or (iii) the first vane of each pair exhibits reverse compound lean, and the second vane of the pair exhibits greater reverse compound lean. Within each unequally-shaped pair the first vane is on the pressure surface side of the second vane.

15 Claims, 3 Drawing Sheets

(52) U.S. Cl.
CPC ..... *F05D 2250/38* (2013.01); *F05D 2250/73* (2013.01)

(56) References Cited

U.S. PATENT DOCUMENTS

| | | | | |
|---|---|---|---|---|
| 2009/0169375 | A1 | 7/2009 | Cortequisse | |
| 2010/0047056 | A1* | 2/2010 | Lee | F01D 9/041 415/115 |
| 2013/0094942 | A1* | 4/2013 | MacKay | F01D 5/141 415/148 |

* cited by examiner

STATOR VANE ROW

FIELD OF THE INVENTION

The present invention relates to an annular row of stator vanes for a gas turbine engine.

BACKGROUND OF THE INVENTION

High pressure (HP) turbine rotor blades and stator vanes of gas turbine engines can be subject to undesirable non-uniform velocity and temperature distributions in the working gas exiting from the combustor. In particular, circumferentially spaced "hot streaks" can be formed in the working gas, each streak extending downstream and originating from one of the circumferentially arranged fuel injectors of the combustor Circumferential non-uniform temperature distribution can affect the heat load on the blades in both the first row of nozzle guide vanes (NGVs) and the following rotor blade row.

A design parameter, termed "clocking", that can influence the NGV heat load is the relative circumferential positioning between the peak temperature of a combustor exit temperature profile (i.e. the centre of a hot streak) and a given NGV. The clocking effect depends on the respective fuel injector and NGV counts. A typical injector-NGV count ratio is 1:2, i.e. one injector corresponds to a pair of vanes.

FIGS. 1(*a*) and 2(*a*) show schematically respective working gas temperature distributions at the combustor exit of an engine, the temperature distributions being superimposed on a view from the front of a pair of NGVs. FIGS. 1(*b*) and 2(*b*) show schematically respective midspan sectional views of the NGVs and the corresponding temperature distributions at midspan. The centre of a hot streak corresponds to the peak temperature in each distribution. As shown in FIGS. 1(*a*) and (*b*), the hot streak can be aligned to impinge on the leading edge of one of the NGVs. In this case, the impinged vane will be subject to a higher heat load than the other NGV of the pair, but an advantage of such an arrangement is that the heat load built produced by the hot streaks on the blade pressure surfaces in the following rotor can be countered to an extent by a "negative jet" associated with NGV wake, the jet causing a pressure surface (PS) side to suction surface (SS) side movement in the working gas. Alternatively, the hot streak can be aligned in the middle of a NGV passage, as shown in FIGS. 2(*a*) and (*b*) to produce a more equal heat load on the NGVs.

One option for managing non-uniform heat load on the NGVs is to have different cooling arrangement for the NGVs, so that NGVs exposed to higher heat loads are subject to additional cooling. However, the non-equal cooling for the two NGVs introduces a non-equal aerodynamic flow field, which may prove to be detrimental to aerothermal performance.

Another option is to shorten the chord length of some NGVs and position these NGVs so that their leading edges are further downstream than the other NGVs. The shortened NGVs can thus effectively be thermally shielded by the adjacent longer NGVs. However, the long and short NGV arrangement can also produce flow non-uniformity which may be detrimental to aerodynamic performance.

These detrimental effects can be exacerbated when there is a strong aerodynamic non-uniformity at the NGV inlet, such as a swirling flow and a non-uniform turbulence intensity, with peak turbulence typically at hot streak centres.

SUMMARY OF THE INVENTION

It would be desirable to provide stator vane arrangement which facilitates an alternative approach to heat load and flow management.

Accordingly, in a first aspect, the present invention provides an annular row of stator vanes for a gas turbine engine, wherein each vane has:

- pressure and suction surfaces which extend radially from an inner to an outer endwall of an annular working gas passage of the engine, and which extend axially from a leading to a trailing edge of the vane, and
- transverse sections which provide respective aerofoil sections; and wherein:

- neighbouring vanes of the annular row are arranged in unequally-shaped pairs in which either: (i) the first vane of each pair exhibits compound lean, and the second vane of the pair exhibits reverse compound lean or has substantially no tangential lean, (ii) the first vane of each pair has substantially no tangential lean, and the second vane of the pair exhibits reverse compound lean, or (iii) the first vane of each pair exhibits reverse compound lean, and the second vane of the pair exhibits greater reverse compound lean; and
- within each unequally-shaped pair the first vane is on the pressure surface side of the second vane.

Advantageously, the non-uniformity in the pair of vanes can accommodate non-uniformity in the working gas arriving at the vanes, and thereby can help to enhance aerothermal performance, e.g. by lowering losses and cooling air requirements.

In a second aspect, the present invention provides a gas turbine engine having the row of stator vanes of the first aspect. The engine may produce circumferentially spaced hot streaks in the working gas flowing through the annular passage, the row of stator vanes being arranged such that each hot streak arrives at a respective unequally-shaped pair of vanes. For example, the row of stator vanes may be arranged such that each hot streak impinges on the second vane of the respective unequally-shaped pair. Such a configuration can place a core of high swirling working gas in a low aerodynamic loading region to reduce mixing losses, and can also place a thermal core of the hot streak in a position to utilize a "negative jet" effect in the vanes' wake to suppress a downstream "positive jet" effect in the wake of a next row of rotor blades. The engine may have a combustor with a plurality of fuel injectors, each hot streak originating from a respective fuel injector. Thus, the injector-vane count ratio may be 1:2.

In a third aspect, the present invention provides one of the unequally-shaped pairs of vanes of the row of stator vanes of the first aspect.

Optional features of the invention will now be set out. These are applicable singly or in any combination with any aspect of the invention.

The stator vanes may be nozzle guide vanes.

Preferably, the first vane exhibits compound lean and the second vane exhibits reverse compound lean.

Within each unequally-shaped pair: the ratio of the circumferential distance between the centroids of the midspan aerofoil sections of the first and second vanes to the total annular circumference at midspan may be termed $\text{Pitch}_m$;

and the ratio of the circumferential distance between the centroids of the aerofoil sections of the first and second vanes at at least one (but generally both) of the endwalls to the total annular circumference at that endwall may be termed $Pitch_0$. Then, preferably $1.0<Pitch_m/Pitch_0$, and more preferably $1.1<Pitch_m/Pitch_0$. Further, preferably $Pitch_m/Pitch_0<1.4$, and more preferably $Pitch_m/Pitch_0<1.3$.

Preferably, within each unequally-shaped pair: the first vane exhibits compound lean; the angular distance between the centroid of the midspan aerofoil section of the first vane and the centroid of the aerofoil section of the first vane at the outer endwall corresponds to a distance of $\Delta t_{cl}$ at the outer endwall; the angular distance between the centroid of the midspan aerofoil section of the first vane and the centroid of the aerofoil section of the first vane at the inner endwall corresponds to a distance of $\Delta h_{cl}$ at the inner endwall, the radial distance between the centroid of the aerofoil section of the first vane at the inner endwall and the centroid of the aerofoil section of the first vane at the outer endwall is $S_1$; and $0.0<\Delta t_{CL}/S_1<0.3$ and $0.0<\Delta h_{CL}/S_1<0.3$.

Preferably, within each unequally-shaped pair: the second vane exhibits reverse compound lean; the angular distance between the centroid of the midspan aerofoil section of the second vane and the centroid of the aerofoil section of the second vane at the outer endwall corresponds to a distance of $\Delta t_{rcl}$ at the outer endwall; the angular distance between the centroid of the midspan aerofoil section of the second vane and the centroid of the aerofoil section of the second vane at the inner endwall corresponds to a distance of $\Delta h_{rcl}$ at the inner endwall; the radial distance between the centroid of the aerofoil section of the second vane at the inner endwall and the centroid of the aerofoil section of the second vane at the outer endwall is $S_2$; and $0.0<\Delta t_{RCL}/S_2<0.3$ and $0.0<\Delta h_{RCL}/S_2<0.3$.

The inner and/or the outer endwall may be lobed, each lobe corresponding to a respective unequally-shaped pair of vanes. For example, the lobes may form maxima and minima in the radial span of the annular passage, each maxima being circumferentially located between the first and second vanes of a respective unequally-shaped pair, and the minima being circumferentially located between the unequally-shaped pairs.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Each aerofoil member of a gas turbine engine (e.g. blade or vane) has a leading edge, a trailing edge, a pressure surface and a suction surface. Transverse cross sections through an aerofoil member provide respective aerofoil sections. Typically the leading and trailing edges of the aerofoil member are not straight lines. Thus, we define the "span line" of a leading or trailing edge as the straight line connecting the end points of the edge, e.g. at respective endwalls. Further we define the "midspan position" of a leading or trailing edge as the position on that edge which is closest to the midpoint of its span line. We also define the "midspan aerofoil section" as the aerofoil section of the aerofoil member which contains the midspan positions of the leading and trailing edges. Indeed, when we state herein that a parameter is "at midspan", we mean that that parameter is being determined at the midspan aerofoil section.

Features of the geometry of the aerofoil member can be defined by the stacking of the aerofoil sections. For example, the "tangential lean" and the "axial lean" of an aerofoil member are defined with reference to the locus of a stacking axis which passes through a common point of each aerofoil section (the common point may be the leading edge, trailing edge or the centroid of each aerofoil section). "Tangential lean" is the displacement, with distance from an endwall, of the stacking axis in a circumferential direction (origin the turbine axis) relative to the position of the stacking axis at the endwall. Similarly, "axial lean" is the upstream or downstream displacement, with distance from an endwall, of the stacking axis relative to its position at the endwall.

The present invention is particularly concerned with types of tangential lean, known as "compound lean" and "reverse compound lean". The extent of tangential lean can be characterised by the displacement of the midspan aerofoil section relative to an endwall aerofoil section. "Compound lean" is when the midspan displacement tends to produce an acute angle between the stacking axis and the endwall on the pressure surface side of the stacking axis. In contrast, "reverse compound lean" is when the midspan displacement tends to produce an acute angle between the stacking axis and the endwall on the suction surface side of the stacking axis.

Figure 1:
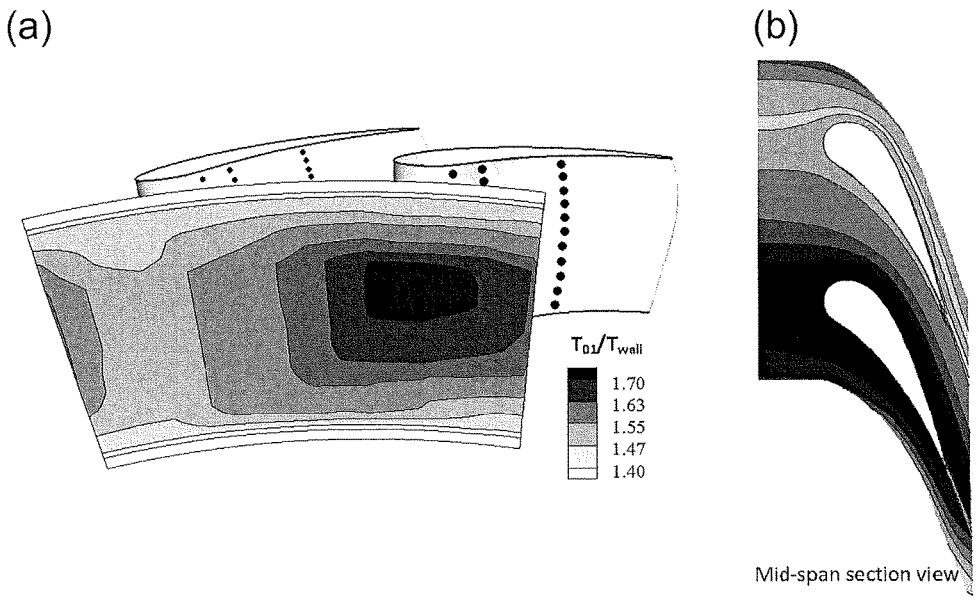
FIG. 1 shows (a) a working gas temperature distribution at the combustor exit of an engine, the temperature distribution being superimposed on a view from the front of a pair of NGVs, and (b) a midspan sectional view of the NGVs and the corresponding temperature distribution at midspan.
Figure 2:
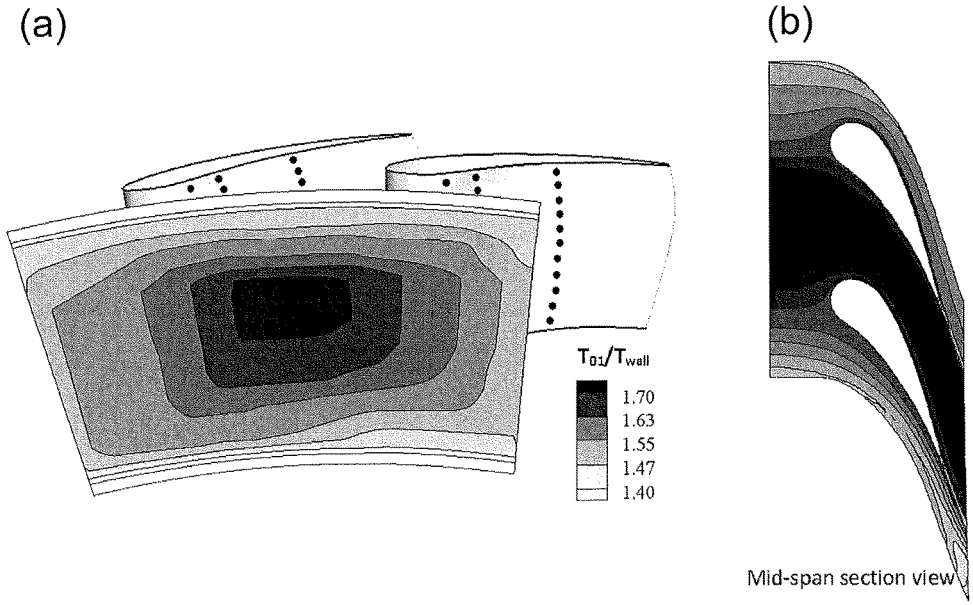
FIG. 2 shows (a) a further working gas temperature distribution at the combustor exit of an engine, the temperature distribution being superimposed on a view from the front of a further pair of NGVs, and (b) a midspan sectional view of the further NGVs and the corresponding further temperature distribution at midspan.
Figure 3:
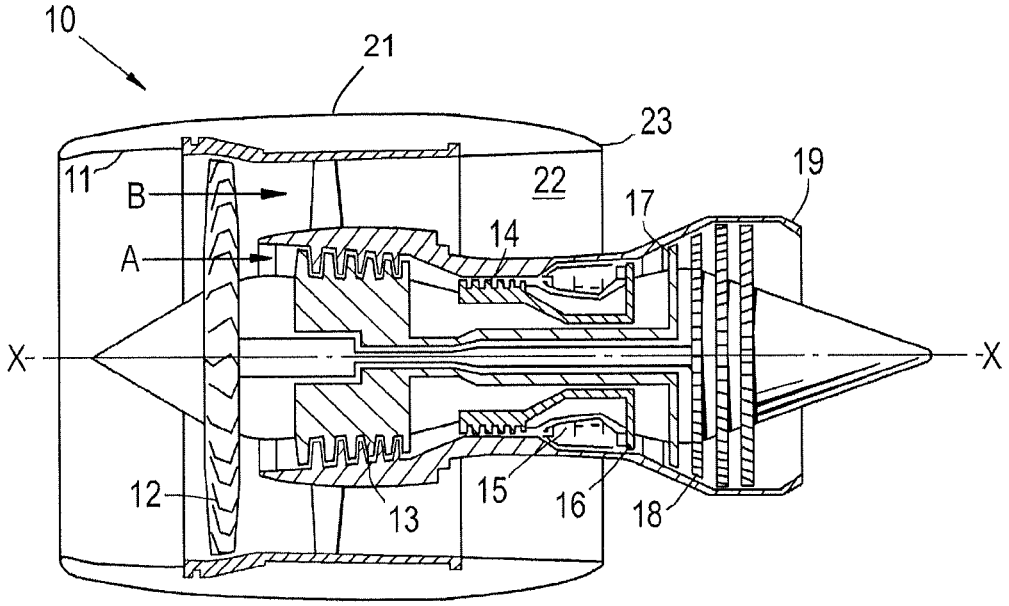
FIG. 3 shows schematically a longitudinal cross-section through a gas turbine engine.

With reference to FIG. 3, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The stator vanes of the engine, and particularly stator vanes such as the NGVs in the high-pressure turbine 16, are arranged in unequally-shaped pairs to accommodate temperature and/or velocity distortions in the working gas exiting from the combustor, such as hot streaks and swirls originating from combustor fuel injectors. For example, for an injector-NGV ratio of 1:2, each NGV and one of its neighbours are allocated to a respective NGV pair. Further, the circumferential length scale of each vane pair can be made equal to the circumferential extent of the temperature and velocity disturbance of a hot streak. In this way, the unequally-shaped NGV pairs can be effective in mitigating the detrimental effects of the combustor exit disturbance so that, for a given non-uniform velocity and temperature inlet condition, improved combined heat transfer and aerodynamic performance can be obtained.

Consider a pair of conventional identical neighbouring NGVs subject to distorted temperature and velocity profiles. A possible non-equal geometrical shaping for the NGVs to mitigate the profiles can be achieved by tangentially leaning the two NGVs independently of one another. High temperature regions are generally associated with large flow loss due to highly swirling flow, and an intent of the tangential leaning can be that the region of hot and lossy flow is contained to a flow path which reduces detrimental effects on the overall high-pressure turbine aerodynamic performance, as well as on the heat load, and particularly the heat load at the rotor tip.

Figure 4:
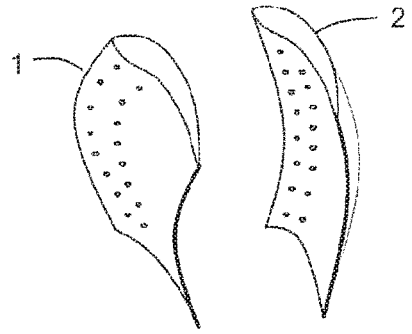
FIG. 4 shows a view from the rear of a pair of NGVs, the two vanes being leant in opposite tangential directions.

FIG. 4 shows a view from the rear of a pair of such NGVs. The two vanes lean in opposite tangential directions. More particularly, one vane 1 exhibits compound lean, and the other vane 2 exhibits reverse compound lean, the compound leant vane being on the pressure surface side of the reverse compound leant vane. The opposing shapes of the vanes have the effect of confining the hot streak to the midspan, reducing the dispersal of the hot streak to the hub and casing platforms (i.e. the inner and outer annulus endwalls) which are difficult to cool. The shaping can also help the pressure surface of the reverse compound leant vane to contain the hot streak. Advantageously, cooling air can be added more efficiently with reduced mixing loss from a pressure surface of a vane than a suction surface (injecting coolant into a lower speed flow being less lossy than injecting into a higher speed flow).

When there are temperature and velocity distortions in the hot gas flow, the unequally-shaped NGV pairs can be configured to achieve the following desirable effects:

(1) placing the core of high swirling flow in a low loading region to reduce further mixing loss generation; and (2) placing the thermal core of the hot streak in a position to utilize the "negative jet" effect of NGV wake to suppress a downstream "positive jet" effect of hot gas migration from the rotor blade suction surface sides to their pressure surface sides (and subsequent secondary flow radial migration of hot gas to the rotor tip).

To satisfy (2) the hot streak/swirl can be made to impinge on one of the vanes. To satisfy (1) the impinged vane preferably has a lower aero-loading at its midspan. A row of equally-shaped and compound leant NGVs would tend to upload the midspan and offload the tip/hub, while a row of reverse compound leant row NGVs would behave oppositely. Thus in a preferred configuration of the unequally-shaped pairs of NGVs, the impinged NGV blade of each pair is reverse compound leant to reduce loading at midspan (i.e. at the core of the high gradient swirling flow). The other blade of the pair operates with a more uniform inflow and may be compound leant to give lower endwall loadings and hence to reduce endwall secondary flow losses.

Although, the operation of the NGVs is described above in relation to a vane pair in which a first vane is compound leant, and the second vane is reverse compound leant with the first vane being on the pressure surface side of the second vane, it is possible to achieve similar effects if only one of the vanes of each pair is tangentially leant, i.e. with the first vane exhibiting compound lean and the second vane having substantially no tangential lean, or the first vane having substantially no tangential lea and the second vane exhibiting reverse compound lean. Indeed, it is also possible to achieve similar effects if both the vanes of each pair exhibit reverse compound lean, but with the second vane exhibiting greater reverse compound lean than the first vane. Thus, overall, if increasing compound lean is viewed as a tendency towards increasingly "positive" tangential lean and if increasing reverse compound lean is viewed as a tendency towards increasingly "negative" tangential lean, in general the first vane should have the more positive tangential lean and the second vane should have the more negative tangential lean. It is then the relatively negative tangential lean of the second vane that can provide the benefits discussed above.

Figure 5:
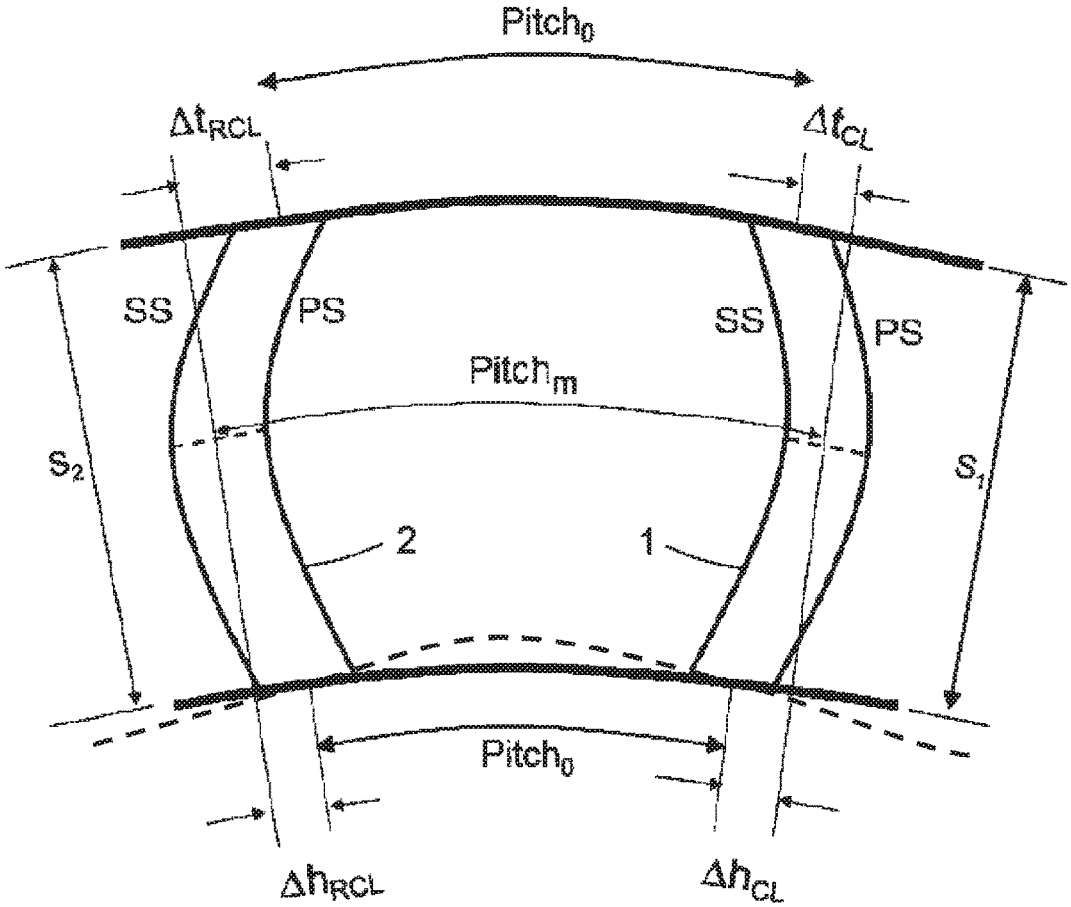
FIG. 5 shows schematically a sectional view from the front of the NGV pair of FIG. 4, the section containing the centroids of the vanes' aerofoil sections.

FIG. 5 shows schematically a sectional view from the front of the NGV pair of FIG. 4, the section containing the centroids of the vanes' aerofoil sections. PS and SS denote the pressure and suction surfaces respectively of the vanes. The tangential lean for the compound leant vane 1 is defined by the circumferential positions of the outer and inner endwall aerofoil sections relative to the midspan aerofoil section, respectively $\Delta t_{CL}$. and $\Delta h_{CL}$ relative to the radial distance between the centroid of the aerofoil section of the compound leant vane at the inner endwall and the centroid of the aerofoil section of the compound leant vane at the outer endwall, $S_1$. Similarly, for the reverse compound leant (and hot streak/swirl impinged) vane 2, the tangential lean is defined by $\Delta t_{RCL}$. and $\Delta h_{RCL}$ respectively, relative to the radial distance between the centroid of the aerofoil section of the reverse compound leant vane at the inner endwall and the centroid of the aerofoil section of the reverse compound leant vane at the outer endwall, $S_2$. Preferably:

$$0.0<\Delta t_{CL}/S_1<0.3$$

$$0.0<\Delta h_{CL}/S_1<0.3$$

$$0.0<\Delta t_{RCL}/S_2<0.3$$

$$0.0<\Delta h_{RCL}/S_{12}<0.3$$

The pitch length (vane-to-vane spacing) at midspan can also vary relative to that of a conventional row of NGVs case with equally shaped vanes. Thus, if the circumferential distance between the centroids of the midspan aerofoil sections of the two vanes (normalised by the total annular circumference at midspan) is $Pitch_m$, and the circumferential distance between the centroids of the aerofoil sections of the two vanes at the inner and/or outer endwall (normalised by the total annular circumference at that endwall) is $Pitch_0$, then preferably $1.0<Pitch_m/Pitch_0$ and $Pitch_m/Pitch_0<1.4$.

The stacking axis of the aerofoil sections of each vane generally bends smoothly in the circumferential direction from the midspan to each endwall to achieve the leant configuration.

The concept of non-equal vane shaping can also work in principle for injector-vane ratios other than 1:2

The endwall surfaces may also be shaped to vary from one inter-vane passage to another. For example, as illustrated by the broken line (inner endwall) shown in FIG. 5, the inner and outer endwalls may be lobed so that the lobes form maxima and minima in the radial span of the working gas annular passage, each maxima being circumferentially located between the first and second vanes of a respective unequally-shaped pair, and the minima being circumferentially located between the unequally-shaped pairs.

To summarise, the non-uniformity in the vanes, and optionally the endwalls, accommodates non-uniformity in the hot gas entering the high-pressure turbine, and thereby helps to enhance aero-thermal performance, e.g. by lowering losses and cooling air requirements.

While the invention has been described in conjunction with the exemplary embodiments described above, many equivalent modifications and variations will be apparent to those skilled in the art when given this disclosure. For example, although illustrated above in relation to an aero gas turbine engine, the present invention may also be applied to land-based gas turbines e.g. for power generation. Accordingly, the exemplary embodiments of the invention set forth above are considered to be illustrative and not limiting. Various changes to the described embodiments may be made without departing from the spirit and scope of the invention.

The invention claimed is:

1. An annular row of stator vanes for a gas turbine engine having a combustor which has a plurality of fuel injectors which produce circumferentially spaced hot streaks in working gas flowing through an annular working gas passage, the annular row of stator vanes comprising a plurality of pairs of unequally-shaped neighbouring vanes, wherein:

each vane includes pressure and suction surfaces which extend radially from an inner to an outer endwall of the annular working gas passage of the engine, and which extend axially from a leading to a trailing edge of the vane, and each vane includes transverse sections which provide respective aerofoil sections;

the neighbouring vanes of each pair include a first vane exhibiting compound lean and a second vane exhibiting reverse compound lean such that the suction surface of the first vane and the pressure surface of the second vane are each concave from the inner endwall to the outer endwall;

the first vane is on the pressure surface side of the second vane within each pair; and the row of stator vanes are arranged such that, in use, each hot streak arrives at a respective pair of vanes.

2. The annular row of stator vanes according to claim 1, wherein, within each pair:

a ratio of circumferential distance between centroids of midspan aerofoil sections of the first and second vanes to total annular circumference at midspan is $Pitch_m$, a ratio of circumferential distance between centroids of aerofoil sections of the first and second vanes at one or more of the endwalls to total annular circumference at that endwall is $Pitch_0$, and $$1.0<Pitch_m/Pitch_0 \text{ and } Pitch_m/Pitch_0<1.4.$$

3. The annular row of stator vanes according to claim 1, wherein, within each pair:

an angular distance between a centroid of a midspan aerofoil section of the first vane and a centroid of an aerofoil section of the first vane at the outer endwall corresponds to a distance of $\Delta t_{cl}$ at the outer endwall, an angular distance between the centroid of the midspan aerofoil section of the first vane and a centroid of an aerofoil section of the first vane at the inner endwall corresponds to a distance of $\Delta h_{cl}$ at the inner endwall, a radial distance between the centroid of the aerofoil section of the first vane at the inner endwall and the centroid of the aerofoil section of the first vane at the outer endwall is $S_1$, and $$0.0<\Delta t_{CL}/S_1<0.3 \text{ and } 0.0<\Delta h_{CL}/S_1<0.3.$$

4. The annular row of stator vanes according to claim 1, wherein, within each pair:

an angular distance between a centroid of a midspan aerofoil section of the second vane and a centroid of an aerofoil section of the second vane at the outer endwall corresponds to a distance of $\Delta t_{rcl}$ at the outer endwall, an angular distance between the centroid of the midspan aerofoil section of the second vane and a centroid of an aerofoil section of the second vane at the inner endwall corresponds to a distance of $\Delta h_{rcl}$ at the inner endwall, a radial distance between the centroid of the aerofoil section of the second vane at the inner endwall and the centroid of the aerofoil section of the second vane at the outer endwall is $S_2$, and $$0.0<\Delta t_{RCL}/S_2<0.3 \text{ and}/0.0<\Delta h_{RCL}/S_2<0.3.$$

5. The annular row of stator vanes according to claim 1, wherein the inner and/or the outer endwall are lobed, each lobe corresponding to a respective pair of vanes.

6. The annular row of stator vanes according to claim 1, wherein the stator vanes are nozzle guide vanes.

7. A gas turbine engine having the annular row of stator vanes of claim 1.

8. The gas turbine engine according to claim 7, which produces circumferentially spaced hot streaks in the working gas flowing through the annular passage, the row of stator vanes being arranged such that each hot streak arrives at a respective pair of vanes.

9. The gas turbine engine according to claim 8, wherein the row of stator vanes is arranged such that each hot streak impinges on the second vane of the respective pair.

10. The gas turbine engine according to claim 8, which has a combustor having a plurality of fuel injectors, and wherein each hot streak originates from a respective fuel injector.

11. A pair of unequally-shaped neighbouring stator vanes, wherein:

each vane includes pressure and suction surfaces which extend radially from an inner endwall to an outer endwall, and which extend axially from a leading to a trailing edge of the vane, and each vane includes transverse sections which provide respective aerofoil sections;

the pair includes a first vane exhibiting compound lean and a second vane exhibiting reverse compound lean such that the suction surface of the first vane and the pressure surface of the second vane are each concave from the inner endwall to the outer endwall; and the first vane is on the pressure surface side of the second vane.

12. A high-pressure turbine comprising the annular row of stator vanes according to claim 1.

13. The annular row of stator vanes according to claim 1, wherein, within each pair:

a ratio of circumferential distance between centroids of midspan aerofoil sections of the first and second vanes to total annular circumference at midspan is $Pitch_m$, a ratio of circumferential distance between centroids of aerofoil sections of the first and second vanes at the outer endwall to total annular circumference at the outer endwall is $Pitch_0$, and $1.0<Pitch_m/Pitch_0$ and $Pitch_m/Pitch_0<1.4$.

14. The pair of unequally-shaped neighbouring stator vanes according to claim 11, wherein:

a ratio of circumferential distance between centroids of midspan aerofoil sections of the first and second vanes to total annular circumference at midspan is $Pitch_m$, a ratio of circumferential distance between centroids of aerofoil sections of the first and second vanes at the outer endwall to total annular circumference at the outer endwall is $Pitch_0$, and $1.0<Pitch_m/Pitch_0$ and $Pitch_m/Pitch_0<1.4$.

15. A gas turbine engine comprising:

a combustor having a plurality of fuel injectors which produce circumferentially spaced hot streaks in working gas flowing through an annular working gas passage; and a high-pressure turbine comprising an annular row of stator vanes that comprises a plurality of pairs of unequally-shaped neighbouring vanes, wherein:

each vane includes pressure and suction surfaces which extend radially from an inner to an outer endwall of the annular working gas passage of the engine, and which extend axially from a leading to a trailing edge of the vane, and each vane includes transverse sections which provide respective aerofoil sections;

the neighbouring vanes of each pair include a first vane exhibiting compound lean and a second vane exhibiting reverse compound lean such that the suction surface of the first vane and the pressure surface of the second vane are each concave from the inner endwall to the outer endwall;

the first vane is on the pressure surface side of the second vane within each pair; and the row of stator vanes are arranged such that, in use, each hot streak arrives at a respective pair of vanes.

* * * * *